US011104171B2

(12) United States Patent
Akiyama et al.

(10) Patent No.: US 11,104,171 B2
(45) Date of Patent: Aug. 31, 2021

(54) THERMAL TRANSFER SHEET

(71) Applicant: Dai Nippon Printing Co., Ltd., Tokyo (JP)

(72) Inventors: Yusaku Akiyama, Tokyo (JP); Kazuki Enokida, Tokyo (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 99 days.

(21) Appl. No.: 16/336,191

(22) PCT Filed: Sep. 22, 2017

(86) PCT No.: PCT/JP2017/034295
§ 371 (c)(1),
(2) Date: Mar. 25, 2019

(87) PCT Pub. No.: WO2018/062039
PCT Pub. Date: Apr. 5, 2018

(65) Prior Publication Data

US 2019/0210390 A1 Jul. 11, 2019

(30) Foreign Application Priority Data

Sep. 30, 2016 (JP) ..... JP2016-194746

(51) Int. Cl.
*B41M 5/50* (2006.01)

(52) U.S. Cl.
CPC ..... *B41M 5/502* (2013.01); *Y10T 428/24843* (2015.01); *Y10T 428/24942* (2015.01)

(58) Field of Classification Search
CPC .. B41M 5/502; B32B 7/06; Y10T 428/24843; Y10T 428/24942
(Continued)

(56) References Cited

U.S. PATENT DOCUMENTS

2009/0036608 A1 2/2009 Ozoe
2016/0067997 A1 3/2016 Oomura et al.
(Continued)

FOREIGN PATENT DOCUMENTS

JP H05-246148 A 9/1993
JP H09-109553 A 4/1997
(Continued)

OTHER PUBLICATIONS

International Search Report (with English translation) and Written Opinion, International Application No. PCT/JP2017/034295, dated Oct. 31, 2017 (10 pages).
(Continued)

*Primary Examiner* — Betelhem Shewareged
(74) *Attorney, Agent, or Firm* — Burr & Brown. PLLC

(57) ABSTRACT

A thermal transfer sheet includes a transfer layer on a substrate. The transfer layer has one or more layers. The critical shearing stress of the transfer layer is within the range of $0.9\times10^8$ N/m$^2$-$2\times10^8$ N/m$^2$. The transfer layer has a release force of $7.5\times10^{-2}$ N/cm or less, while the transfer layer is continuously transferred onto a transfer receiving article by use of a thermal printer under conditions including an applied energy of 0.127 mJ/dot and a conveying speed for the thermal transfer sheet of 84.6 mm/sec. The transfer layer transferred onto the transfer receiving article is released from the thermal transfer sheet at a release angle of 50°.

4 Claims, 2 Drawing Sheets

(58) Field of Classification Search
USPC ..... 428/32.77
See application file for complete search history.

(56) References Cited

U.S. PATENT DOCUMENTS

| | | | | |
|---|---|---|---|---|
| 2019/0002103 | A1 | 7/2019 | Akiyama et al. | |
| 2019/0210390 | A1* | 7/2019 | Akiyama | B32B 7/06 |

FOREIGN PATENT DOCUMENTS

| | | | | | |
|---|---|---|---|---|---|
| JP | H09-290576 | A | | 11/1997 | |
| JP | H11-263079 | A | | 9/1999 | |
| JP | 2000-108524 | A | | 4/2000 | |
| JP | 2001-039038 | A | | 2/2001 | |
| JP | 2001-246845 | A | | 9/2001 | |
| JP | 2002-264544 | A | | 9/2002 | |
| JP | 2006-299008 | A1 | | 11/2006 | |
| JP | 2007-039654 | A1 | | 2/2007 | |
| JP | 2012-101370 | A | | 5/2012 | |
| JP | 2012101370 | | * | 5/2012 | B41M 5/26 |
| JP | 2014-065265 | A | | 4/2014 | |
| JP | 2015-197082 | A1 | | 11/2015 | |
| JP | 2017-065234 | A | | 4/2017 | |
| JP | 2017-105107 | A | | 6/2017 | |
| WO | 2014/157678 | A1 | | 10/2014 | |
| WO | 2018/062039 | A1 | | 4/2018 | |

OTHER PUBLICATIONS

Japanese Office Action (Application No. 2019-114879) dated Jun. 22, 2021 (with English translation).

* cited by examiner

THERMAL TRANSFER SHEET

FIELD OF THE INVENTION

The present invention relates to a thermal transfer sheet.

BACKGROUND OF THE INVENTION

There are known various types of thermal transfer sheets for transferring a transfer layer onto a transfer receiving article. For example, thermal transfer sheets suggested in Patent Literatures 1 to 3 are known, such as: (i) a thermal transfer sheet in which a thermally fusible ink layer as the transfer layer is provided on one surface of the substrate, (ii) a thermal transfer sheet in which a receiving layer as the transfer layer is provided on one surface of the substrate (it is referred to as an intermediate transfer medium, occasionally), (iii) a thermal transfer sheet in which a protective layer (it is referred to as an exfoliate layer, occasionally) as the transfer layer is provided on one surface of the substrate (it is referred to as a protective layer transfer sheet, occasionally), and (iv) thermal transfer sheets including an appropriate combination of these structures, for example, a thermal transfer sheet in which a transfer layer of a layered-structure including an exfoliate layer and a receiving layer layered in this order from the side of the substrate is provided on one surface of the substrate and a thermal transfer sheet in which a thermally fusible ink layer and a protective layer are provided on the same surface of the substrate so as to be layered in parallel on the substrate across the surface of the substrate, as being frame sequentially. The transfer layer of these thermal transfer sheets is transferred onto a transfer receiving article by superposing such a thermal transfer sheet on the transfer receiving article and heating the other side of the substrate by a heating device such as a thermal head and a heating roller.

The market is now highly demanding printers highly suitable for high-speed printing. Energy applied to a thermal transfer sheet when a transfer layer is transferred onto a transfer receiving article inside a printer has been steadily increasing. Transfer of the transfer layer onto a transfer receiving article is carried out by applying thermal energy to the thermal transfer sheet while the transfer receiving article and the transfer layer of the thermal transfer sheet are kept in close contact to each other to transfer the transfer layer onto the transfer receiving article and releasing the transfer layer transferred on the transfer receiving article from the thermal transfer sheet. As printers used for transferring the transfer layer of thermal transfer sheets, there are known hot release-type printers that apply thermal energy to a thermal transfer sheet to melt or soften the transfer layer and release only the transfer layer transferred on a transfer receiving article from the thermal transfer sheet before this transfer layer solidifies and cold release-type printers that release only the transfer layer transferred on the transfer receiving article from the thermal transfer sheet after the transfer layer has solidified. Incidentally, in the case where a transfer receiving article and the thermal transfer sheet are thermally fused to each other when the transfer layer of the thermal transfer sheet is transferred onto the transfer receiving article, specifically, in the case where the transfer receiving article and the thermal transfer sheet adhere to each other to such an extent that it is not possible to release the transfer layer transferred on transfer receiving article from the thermal transfer sheet, for example, in the case where the transfer layer and the substrate are thermally fused to each other unintentionally when the thermal transfer sheet in which the transfer layer is provided directly on the substrate is used to transfer the transfer layer onto the transfer receiving article, problems are likely to occur such as rupture of the thermal transfer sheet inside the printer, conveyance failures of the thermal transfer sheet inside the printer (it is referred to as a jam, occasionally), and the like. Particularly, as thermal energy applied to the thermal transfer sheet is increased when the transfer layer is transferred, the occurrence frequency of thermal fusion between the transfer receiving article and the thermal transfer sheet and conveyance failures caused by thermal fusion tends to increase.

Under such circumstances, although various studies have been made to suppress the thermal fusion between a transfer receiving article and a thermal transfer sheet, there is a room for improvement on measures for the thermal fusion between a transfer receiving article and a thermal transfer sheet, which may occur when the transfer layer of the thermal transfer sheet is transferred onto the transfer receiving article by applying high energy to the thermal transfer sheet.

In addition, printers have been downsized recently. As a result, the conveyance paths for thermal transfer sheets and transfer receiving articles inside printers tend to be dense and complex. In the case where such a downsized printer is employed, a thermal transfer sheet comes into contact with a transfer receiving article or the internal mechanism of the printer before the transfer layer is transferred onto a transfer receiving article. The impact or the like at this time is likely to cause the foil fall of the transfer layer, in which a portion or the whole of the transfer layer falls off from the thermal transfer sheet inside the printer.

CITATION LIST

Patent Literature

Patent Literature 1: Japanese Patent Laid-Open No. 9-290576

Patent Literature 2: Japanese Patent Laid-Open No. 11-263079

Patent Literature 3: Japanese Patent Laid-Open No. 2001-246845

SUMMARY OF INVENTION

Technical Problem

The present invention has been made in view of the above-mentioned circumstances, and the present invention aims principally to provide a thermal transfer sheet capable of suppressing the thermal fusion between a transfer receiving article and the thermal transfer sheet inside a printer and capable of suppressing unintended fall-off of the transfer layer inside the printer even in the case where the amount of energy applied to the thermal transfer sheet is increased.

Solution to Problem

The present invention for solving the above-mentioned problems is a thermal transfer sheet including a substrate and a transfer layer provided on one surface of the substrate, wherein the transfer layer has a single-layer structure constituted by one layer or a layered-structure layered two or more layers, the critical shearing stress of the transfer layer is $0.9\times10^8$ N/m$^2$ or more when the transfer layer is transferred onto a transfer receiving article and the surface of the transfer layer after transferred onto the transfer receiving article is measured by a micro-scratch method in compliance with JIS-R-3255 (1997), and the transfer layer has a release force of $7.5\times10^{-2}$ N/cm or less, and the release force of the transfer layer is a tensile strength of the thermal transfer sheet measured by a measuring device at the timing when, while the transfer layer is transferred onto a transfer receiving article by use of a printer comprising a thermal transfer sheet supplying device, a heating device, a thermal transfer sheet winding device, the measuring device located between the heating device and the thermal transfer sheet winding device to measure the tensile strength of the thermal transfer sheet conveyed along a conveyance path, and a release device located between the heating device and the measuring device, under conditions including an applied energy of 0.127 mJ/dot and a conveying speed for the thermal transfer sheet of 84.6 mm/sec., the transfer layer transferred onto the transfer receiving article is released from the thermal transfer sheet at a release angle of 50°.

The critical shearing stress may be within the range of $0.9\times10^{8}$ N/m$^2$ or more and $2\times10^{8}$ N/m$^2$ or less.

Advantageous Effect of Invention

According to the thermal transfer sheet of the present invention, it is possible to suppress the thermal fusion between a transfer receiving article and the transfer layer inside a printer and it is also possible to suppress fall-off of the transfer layer inside the printer, even in the case where the amount of energy applied to the thermal transfer sheet is increased.

DETAILED DESCRIPTION OF THE INVENTION

<<Thermal Transfer Sheet>>

Figure 1:
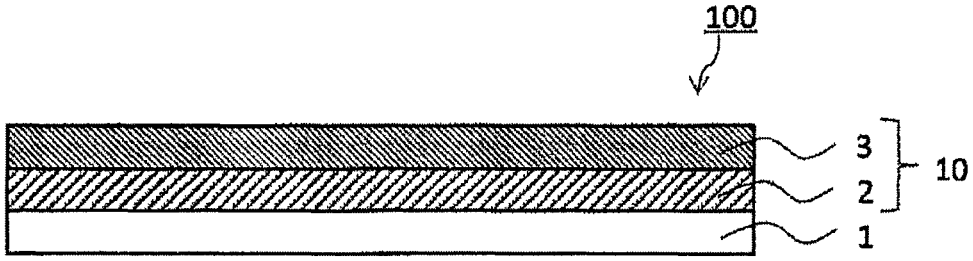
FIG. 1 is a schematic sectional view illustrating one example of a thermal transfer sheet of the present invention.
Figure 2:
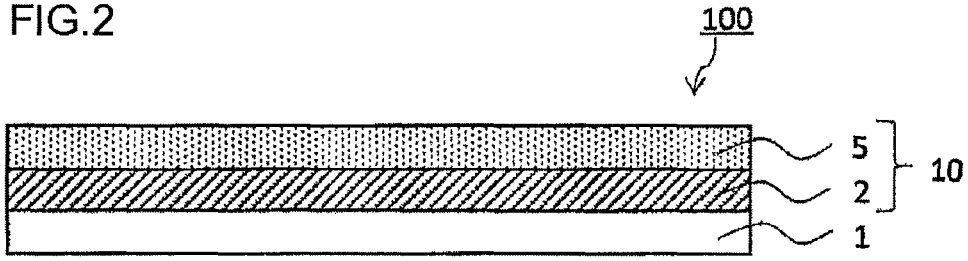
FIG. 2 is a schematic sectional view illustrating one example of a thermal transfer sheet of the present invention.
Figure 3:
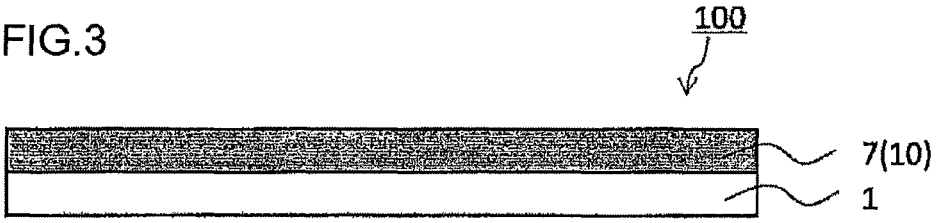
FIG. 3 is a schematic sectional view illustrating one example of a thermal transfer sheet of the present invention.

Hereinafter, a thermal transfer sheet of one embodiment of the present invention (hereinafter, it may be referred to as the thermal transfer sheet of one embodiment) will be described in detail. FIGS. 1 to 3 are schematic sectional views each illustrating one example of a thermal transfer sheet of one embodiment. As shown in FIGS. 1 to 3, a thermal transfer sheet 100 of one embodiment includes a substrate 1 and a transfer layer 10 releasably provided on the substrate 1. The transfer layer 10 may have a layered-structure in which two or more layers are layered as shown in FIGS. 1 and 2 or may have a single-layer structure constituted by one layer as shown in FIG. 3.

One of the problems that may occur when the transfer layer of the thermal transfer sheet is transferred onto a transfer receiving article is thermal fusion between the transfer receiving article and the thermal transfer sheet. The thermal fusion between an transfer receiving article and the thermal transfer sheet referred to herein means a phenomenon in which, in the case where the thermal transfer sheet is superposed on the transfer receiving article, the transfer layer is transferred onto the transfer receiving article by applying thermal energy to the thermal transfer sheet side by a heating device such as a thermal head, and only the transfer layer transferred on the transfer receiving article is released from the thermal transfer sheet, a constituent member of the thermal transfer sheet, which should intrinsically remain on the thermal transfer sheet side, is united with the transfer layer transferred on the transfer receiving article, and thus it is not possible to release only the transfer layer transferred on the transfer receiving article from the thermal transfer sheet.

More specifically, for example, thermal fusion means a phenomenon in which, when a thermal transfer sheet in which the transfer layer is provided directly on the substrate is used, the substrate is united with the transfer layer to such an extent that the transfer layer transferred on the transfer receiving article cannot be released from the substrate. Alternatively, the thermal fusion means a phenomenon in which, even if only the transfer layer transferred on the transfer receiving article can be released from the thermal transfer sheet, the constituent member of the thermal transfer sheet is united with the transfer layer transferred on the transfer receiving article to such an extent that unusual noises occur when the transfer layer is released. When the transfer receiving article and the thermal transfer sheet are thermally fused to each other, such thermal fusion may be responsible for conveyance failures inside a printer, transfer defects, and the like. Alternatively, when the transfer receiving article and the thermal transfer sheet are thermally fused to each other to a lower extent, the transfer layer transferred on the transfer receiving article can be released from the thermal transfer sheet, but the release interface of the transfer layer may be roughened to lead to a decrease in the glossiness.

As countermeasures to suppress the thermal fusion between a transfer receiving article and the thermal transfer sheet, which may occur when the transfer layer of the thermal transfer sheet is transferred onto the transfer receiving article, a countermeasure to improve the heat resistance of the transfer layer, a countermeasure to improve the release property of the transfer layer from the substrate, and the like have been taken, for example. However, since these countermeasures have been taken, the thermal fusion between the transfer receiving article and the thermal transfer sheet can be suppressed under predetermined transfer conditions. However, depending on conditions of the thermal energy to be applied onto the thermal transfer sheet when the transfer layer is transferred, the thermal fusion between the transfer receiving article and the thermal transfer sheet may be often insufficiently suppressed. At present, the thermal fusion between the transfer receiving article and the thermal transfer sheet cannot be yet sufficiently suppressed, irrespective of transfer conditions in the case where the transfer layer is transferred onto the transfer receiving article. Specifically, the thermal fusion between the transfer receiving article and the thermal transfer sheet cannot be yet sufficiently suppressed at present, in the case where the amount of energy applied to the thermal transfer sheet is increased when the transfer layer is transferred onto the transfer receiving article and the like.

Under such circumstances, investigation on thermal transfer sheets capable of suppressing occurrence of the thermal fusion with a transfer receiving article has found that the thermal fusion between the transfer receiving article and the thermal transfer sheet is in close relation with the release force when the transfer layer 10 transferred on the transfer receiving article is released from the constituent member in direct contact with the transfer layer (hereinafter, it is referred to as the constituent member in contact with the transfer layer) among the constituent members constituting the thermal transfer sheet, for example, the release force in releasing from the substrate 1, and reducing the release force can suppress occurrence of the thermal fusion between the transfer receiving article and the thermal transfer sheet. Incidentally, it is difficult to precisely measure, in a printer, the release force when the transfer layer 10 transferred on the transfer receiving article is released from the constituent member in contact with the transfer layer, and there is a problem that it is not possible to find the critical value of the release force at which thermal fusion occurs between the transfer receiving article and the thermal transfer sheet. Further investigation on this respect has found that, in a printer, the release force when the transfer layer 10 transferred on the transfer receiving article is released from the constituent member in contact with the transfer layer correlates with the tensile strength applied to the thermal transfer sheet during the release and that the tensile strength applied to the thermal transfer sheet during the release is in a close relation with the thermal fusion between the transfer receiving article and the thermal transfer sheet. Hereinbelow, the case where the constituent member in direct contact with the transfer layer, among the constituent members included in the thermal transfer sheet, is the substrate will be mainly described. However, the thermal transfer sheet of one embodiment is not limited to aspects in which the substrate is in direct contact with the transfer layer, and an optional layer may be provided between the substrate and the transfer layer. In such a case, the optional layer will be the constituent member that comes in direct contact with the transfer layer.

The thermal transfer sheet of one embodiment, which takes such a respect into account, is characterized by satisfying the following (Condition 1), as one aspect.

Figure 4:
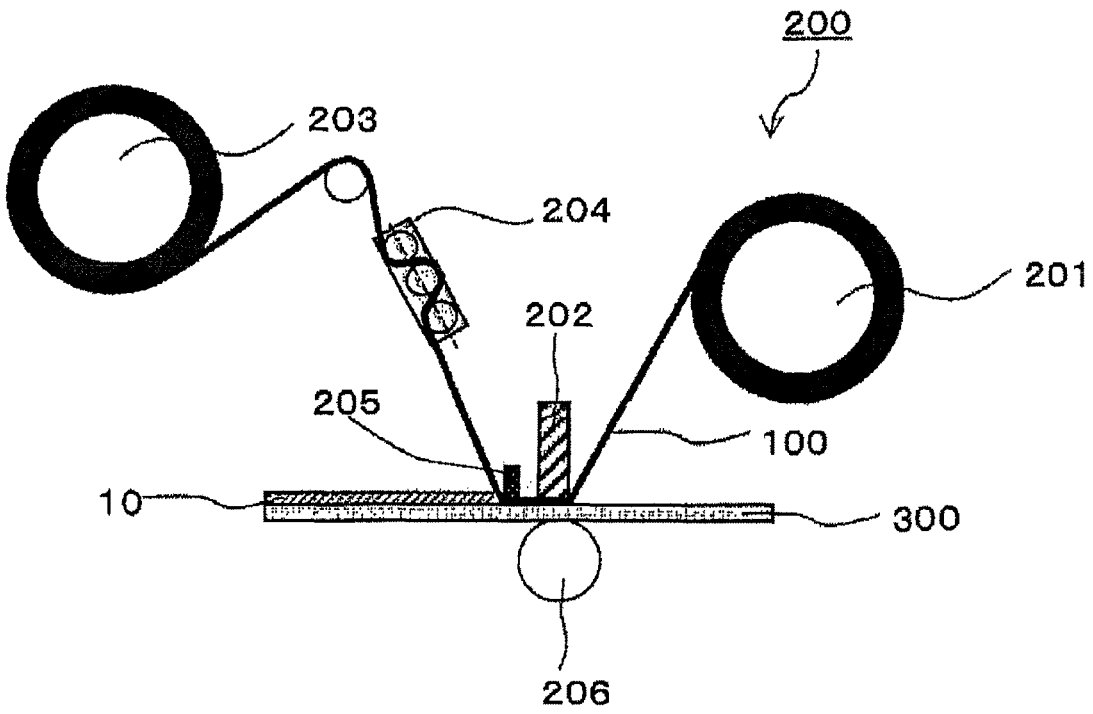
FIG. 4 is a schematic view illustrating one example of a printer used when the transfer layer of the thermal transfer sheet is transferred.

(Condition 1): The release force of the transfer layer 10 is $7.5\times10^{-2}$ N/cm or less, and the release force of the transfer layer 10 is a tensile strength of the thermal transfer sheet measured by a measuring device 204 at the timing when, while a thermal transfer sheet 100 is superposed on a transfer receiving article and, as shown in FIG. 4, the transfer layer 10 is continuously transferred onto the transfer receiving article 300 by use of a printer 200 comprising a thermal transfer sheet supplying device 201, a heating device 202, a thermal transfer sheet winding device 203, the measuring device 204 located between the heating device 202 and the thermal transfer sheet winding device 203 to measure the tensile strength of the thermal transfer sheet conveyed along a conveyance path, and a release device 205 located between the heating device 202 and the measuring device 204, under conditions including an applied energy of 0.127 mJ/dot and a conveying speed for the thermal transfer sheet of 84.6 mm/sec., the transfer layer 10 transferred onto the transfer receiving article 300 is released from the thermal transfer sheet 100 at a release angle of 50°.

Hereinafter, the tensile strength of the thermal transfer sheet measured by the measuring device 204 at the timing when, while the transfer layer 10 is continuously transferred onto the transfer receiving article 300 by use of the printer 200 comprising the thermal transfer sheet supplying device 201, the heating device 202, the thermal transfer sheet winding device 203, the measuring device 204 located between the heating device 202 and the thermal transfer sheet winding device 203 to measure the tensile strength of the thermal transfer sheet conveyed along a conveyance path, and the release device 205 located between the heating device 202 and the measuring device 204, under conditions including an applied energy of 0.127 mJ/dot and a conveying speed for the thermal transfer sheet of 84.6 mm/sec., the transfer layer 10 transferred onto the transfer receiving article 300 is released from the side of the thermal transfer sheet 100 (e.g., the substrate 1) at a release angle of 50° may be simply referred to as the tensile strength of the thermal transfer sheet.

The applied energy (mJ/dot) referred to herein is the applied energy calculated by the following expression (1), and the applied power [W] in the expression (1) can be calculated by the following expression (2):

$$\text{Applied energy (mJ/dot)} = W \times L.S. \times P.D. \times \text{energy gradation value} \quad (1)$$

(wherein [W] means the applied power, [L.S.] means the line cycle (msec./line), and [P.D.] means the pulse duty.)

$$\text{Applied power (W/dot)} = V^2/R \quad (2)$$

(Wherein [V] means the applied voltage, and [R] means the resistance of the heating device.)

The conveying speed of the thermal transfer sheet (mm/sec.) referred to herein is the conveying speed calculated by the following expression (3):

$$\text{Conveying speed (mm/sec.)} = (25.4/(\text{sub scanning direction printing density (dot/inch)} \times \text{line cycle (msec./line)})) \times 1000 \quad (3)$$

(wherein 25.4 is a numerical value used to convert inches into mm.)

The tensile strength (N/cm) measured by the measuring device, referred to herein, is a value obtained by dividing the stress (N) determined by the measuring device under the above conditions by the heating width (cm) of the thermal transfer sheet.

According to the thermal transfer sheet of one embodiment which satisfies the above (Condition 1), it is possible to suppress the thermal fusion between the transfer receiving article 300 and the thermal transfer sheet 100, which may occur when the transfer layer 10 is transferred onto the transfer receiving article 300, without being influenced by various conditions when the transfer layer 10 is transferred onto the transfer receiving article 300. Specifically, in order to meet high-speed printing suitability, in the case where thermal energy applied to the thermal transfer sheet is increased, the thermal fusion between a transfer receiving article and the thermal transfer sheet can be suppressed.

Additionally, regardless the transfer conditions, the thermal transfer sheet 100 of one embodiment, which can suppress the thermal fusion between a transfer receiving article and the thermal transfer sheet, can also suppress occurrence of surface roughness and the like when the transfer layer 10 is released from the substrate 1 and can make the glossiness of the transfer layer 10 transferred on the transfer receiving article 300 better.

The conditions for measuring the tensile strength of the thermal transfer sheet include an applied energy of 0.127 mJ/dot. This is because, even in the case where the tensile strength of the thermal transfer sheet measured by the measuring device 204 is $7.5\times10^{-2}$ N/cm or less when the applied energy is set to less than 0.127 mJ/dot, it is not possible to suppress occurrence of the thermal fusion between the transfer receiving article 300 and the thermal transfer sheet 100 depending on the transfer conditions, unless the tensile strength of the thermal transfer sheet measured by the measuring device 204 is $7.5\times10^{-2}$ N/cm or less when the applied energy is set at 0.127 mJ/dot.

The printer 200 used when the transfer layer 10 is transferred onto the transfer receiving article 300, if capable of measuring the tensile strength of the thermal transfer sheet at the timing when the transfer layer is released from the side of the thermal transfer sheet at a release angle of 50°, may be a hot release-type printer that melts or softens the transfer layer 10 and releases the transferred transfer layer 10 from the substrate 1 before this transfer layer solidifies or may be a cold release-type printer that releases the transferred transfer layer 10 from the substrate 1 after the transfer layer 10 solidifies.

In the case where a hot release-type printer is used, additionally, the tensile strength of the thermal transfer sheet measured by the measuring device 204 at the timing when the transfer layer 10 transferred onto the transfer receiving article 300 is released from the side of the thermal transfer sheet at a release angle of 50°, 0.05 sec. after the transfer layer 10 is transferred onto the transfer receiving article 300 is preferably $7.5\times10^{-2}$ N/cm or less. According to the thermal transfer sheet 100 of one embodiment, which satisfies these conditions, even in the case where a hot release-type printer is used and the time from the completion of thermal energy application to the release of the transfer layer 10 from the side of the thermal transfer sheet is shortened, it is possible to sufficiently suppress occurrence of the thermal fusion between the transfer receiving article 300 and the thermal transfer sheet 100.

(Printer)

Next, a description will be given on a printer for use in measuring the tensile strength of the thermal transfer sheet.

As shown in FIG. 4, the printer 200 for use in measuring the tensile strength of the thermal transfer sheet comprises a thermal transfer sheet supplying roller as a thermal transfer sheet supplying device 201 for conveying the thermal transfer sheet 100 along a predetermined path and a winding roller as a thermal transfer sheet winding device 203, a thermal head as a heating device 202 for heating the back face side of the thermal transfer sheet 100 to transfer the transfer layer 10 onto the transfer receiving article 300, a platen roller 206 that can move the transfer receiving article 300 to the location onto which the transfer layer 10 is transferred, a release plate as a release device 205 that is located between the heating device 202 and the winding device 203 and releases the transfer layer 10 transferred on the transfer receiving article 300 from the substrate 1 after the transfer layer 10 is transferred onto the transfer receiving article 300, and a tension meter as a measuring device 204 that is located between the heating device 202 (release device 205) and the thermal transfer sheet winding device 203 on the conveying path for the thermal transfer sheet 100 and measures the tensile strength applied on the thermal transfer sheet at the timing when the transfer layer 10 transferred onto the transfer receiving article 300 is released from the side of the thermal transfer sheet 100 (e.g., from the substrate 1) at a release angle of 50° while the transfer layer 10 is continuously transferred onto the transfer receiving article 300.

Conventionally known printers can be appropriately set and used as the printer 200 in measuring the tensile strength of the thermal transfer sheet, except that the printer 200 includes a measuring device 204 that is located between the heating device 202 and the thermal transfer sheet winding device 203 on the conveying path for the thermal transfer sheet 100 and measures the tensile strength of the thermal transfer sheet when the transfer layer 10 transferred on the transfer receiving article 300 is released at the release angle of 50° from the substrate 1 while transferring the transfer layer 10 onto the transfer receiving article 300.

The measuring device 204 is only required to be a measuring device that can measure the tensile strength of the thermal transfer sheet running on the conveyance path and a tension meter (model ASK-1000, OHKURA INDUSTRY) can be used. The tensile strength referred to herein is synonymous with tension, and a tensile strength value represents a substantial value of the release force when the transfer layer 10 transferred on the transfer receiving article 300 is released from the substrate 1 after the transfer layer 10 is transferred onto the transfer receiving article 300. According to the printer 200 including the measuring device 204 located between the heating device 202 and the thermal transfer sheet winding device 203, it is possible to measure the tensile strength of the thermal transfer sheet when the transfer layer 10 transferred on the transfer receiving article 300 is released at the release angle of 50° from the substrate 1 while transferring the transfer layer 10 onto the transfer receiving article 300 by means of release device 205. Specifically, it is possible to measure the substantial release force when the transfer layer 10 is released from the substrate 1 by continuously releasing the transfer layer 10 transferred on the transfer receiving article from the substrate 1 while continuously transferring the transfer layer 10 onto the transfer receiving article 300.

The release device 205 is only required to be located between the heating device 202 and the measuring device 204, and there is no limitation on the location. In the case of a hot release-type printer, the release device is only required to be placed in such a location that the release device 205 reaches the transfer layer 10 transferred on the transfer receiving article 300 after 0.05 sec. In one example, the release device 205 is located at a point 4.5 mm distant from the heating device 202 in the conveying direction. Based on the distance from the heating device 202 to the release device 205 and the conveying speed of the thermal transfer sheet, it is possible to calculate the time until the transfer layer 10 transferred on the transfer receiving article 300 is released by the release device 205.

The thermal transfer sheet 100 of one embodiment is characterized by satisfying the following (Condition 2) in addition to the above (Condition 1), as one aspect.

(Condition 2): the critical shearing stress is $0.9\times10^{8}$ N/m$^2$ or more when the transfer layer 10 is transferred onto a transfer receiving article and the surface of the transfer layer 10 transferred onto the transfer receiving article is measured by a micro-scratch method in compliance with JIS-R-3255 (1997).

In other words, the critical shearing stress is $0.9\times10^{8}$ N/m$^2$ or more when the layer located nearest the substrate 1 among the layers constituting the transfer layer 10 is measured by a micro-scratch method in compliance with JIS-R-3255 (1997).

Hereinafter, the critical shearing stress obtained when the transfer layer 10 is transferred onto a transfer receiving article and the surface of the transfer layer 10 transferred onto the transfer receiving article is measured by a micro-scratch method in compliance with JIS-R-3255 (1997) may be simply referred to as the critical shearing stress. When the transfer layer 10 is transferred onto a transfer receiving article, the layer located on the surface of the transfer layer 10 transferred onto the transfer receiving article may be referred to as the layer located on the transfer interface of the transfer layer. The layer located on the surface of the transfer layer 10 transferred onto the transfer receiving article is synonymous with the layer located nearest the substrate 1 among the layers constituting 10.

According to the thermal transfer sheet 100 of one embodiment, which satisfies the above (Condition 2), setting the critical shearing stress of the layer located on the transfer interface of the transfer layer 10 at $0.9\times10^8$ N/m$^2$ or more can suppress fall-off of a portion or the whole of the transfer layer before transfer from the thermal transfer sheet 100, even when the thermal transfer sheet comes into contact, collides or the like with the transfer receiving article or the internal mechanism of the printer, inside the printer. For example, in the case where a small printer having a dense and complex conveyance path is employed, the thermal transfer sheet is more likely to come in contact or collide with a transfer receiving article or the internal mechanism of the printer. In the thermal transfer sheet of one embodiment, the layer located on the transfer interface of the transfer layer 10 is reinforced by satisfying the above (Condition 2). Thus, when such contact or the like occurs, it is possible to suppress unintentional fall-off of the transfer layer 10. In other words, it is possible to suppress foil fall of the transfer layer.

In the thermal transfer sheet 100 of one embodiment, the reason why the layer having a critical shearing stress of $0.9\times10^8$ N/m$^2$ or more is used as the layer located nearest the substrate 1 among the layers constituting the transfer layer 10, in other words, used as the layer located on the transfer interface of the transfer layer 10, is that the transfer layer 10 is likely to fall off from the transfer interface of the transfer layer 10 as a starting point. In the thermal transfer sheet 100 of one embodiment, the critical shearing stress of the layer is set at $0.9\times10^8$ N/m$^2$ or more in order to suppress fall-off of the transfer layer 10. That is, the thermal transfer sheet 100 of one embodiment is characterized by imparting impact resistance to the layer located on the transfer interface of the transfer layer 10 by satisfying the above (Condition 2).

There is no particular limitation with respect to the upper limit of the critical shearing stress of the layer located on the transfer interface of the transfer layer 10, but the critical shearing stress is preferably $2\times10^8$ N/m$^2$ or less, more preferably $1.65\times10^8$ N/m$^2$ or less. Setting the critical shearing stress within the range of $0.9\times10^8$ N/m$^2$ or more and $2\times10^8$ N/m$^2$ or less, more preferably within the range of $0.9\times10^8$ N/m$^2$ or more and $1.65\times10^8$ N/m$^2$ or less can suppress fall-off of the transfer layer 10 and can improve the foil cutting property when the transfer layer 10 is transferred. The foil cutting property of the transfer layer 10 referred to herein represents the degree of suppression of tailing when the transfer layer is transferred on a transfer receiving article, and means that the occurrence of the tailing can be sufficiently suppressed when the foil cutting property is good. The tailing referred to herein means a phenomenon in which the transfer layer 10 is transferred so as to protrude to a non-transfer region side from a boundary between a transfer region and the non-transfer region of the transfer layer 10 as a starting point when the transfer layer 10 is transferred onto the transfer receiving article 300.

Then, the specific structure of the thermal transfer sheet 100, which satisfies the above (Condition 1) and (Condition 2), will be described with reference to one example. The thermal transfer sheet 100 of one embodiment is only required to satisfy the above (Condition 1) and (Condition 2) and is not limited in any way with respect to any other matters. There is also no limitation on specific devices to satisfy the above (Condition 1) and (Condition 2), and it is possible to apply any devices that can satisfy the above (Condition 1) and (Condition 2). Hereinafter, specific devices to satisfy the above (Condition 1) and (Condition 2) will be described with reference to one example, but the devices are not limited thereto.

(First Device)

A first device is a device for adjusting the release force of the transfer layer 10 (the tensile strength of the thermal transfer sheet 100) and the critical shearing stress of the layer located on the transfer interface of the transfer layer 10 (the critical shearing stress of the layer located nearest the substrate 1 among the layers constituting the transfer layer 10) so as to satisfy the above (Condition 1) and (Condition 2) by appropriately selecting a component to be contained in the layer located on the transfer interface of the transfer layer 10.

For example, as shown in FIG. 1, in the case where a transfer layer 10 of a layered-structure in which an exfoliate layer 2 and an adhesive layer 3 are layered in this order from the side of the substrate 1 is provided on a substrate 1, it is possible to adjust the release force of the transfer layer 10 and the critical shearing stress of the layer located on the transfer interface of the transfer layer 10 so as to satisfy the above (Condition 1) and (Condition 2) by appropriately selecting a resin material to be contained in the exfoliate layer 2 located on the transfer interface, for example, considering the molecular weight and glass transition temperature of the resin material, monomers constituting the resin material or the like. Hereinafter, the case where the exfoliate layer 2 is the layer located on the transfer interface of the transfer layer 10 will be mainly described. However, the layer located on the transfer interface of the transfer layer 10 may be a layer other than this layer.

One example can be a device in which the exfoliate layer 2 is allowed to contain an acrylic resin having a weight average molecular weight (Mw) of 70000 or more and a glass transition temperature (Tg) of 70° C. or more and 100° C. or less. In the case where the exfoliate layer 2 contains an acrylic resin having a weight average molecular weight (Mw) of 70000 or more and a glass transition temperature (Tg) of 70° C. or more and 100° C. or less, it is possible to easily adjust the release force of the transfer layer 10 and the critical shearing stress of the layer located on the transfer interface of the transfer layer 10 so as to satisfy the above (Condition 1) and (Condition 2) by adjusting the thickness of the exfoliate layer 2. The thickness of the exfoliate layer 2, which contains an acrylic resin having a weight average molecular weight (Mw) of 70000 or more and a glass transition temperature (Tg) of 70° C. or more and 100° C. or less is preferably in the range of 0.2 μm or more and 0.6 μm or less. In the case where the exfoliate layer 2 contains an acrylic resin having a weight average molecular weight (Mw) of 70000 or more and a glass transition temperature (Tg) of 70° C. or more and 100° C. or less as well as has a thickness in the range of 0.2 μm or more and 0.6 μm or less, it is possible to make the foil cutting property of the transfer layer 10 containing the exfoliate layer 2 better in addition to satisfying the above (Condition 1) and (Condition 2).

The weight average molecular weight (Mw) referred to herein means a weight average molecular weight in terms of polystyrene, measured by GPC (gel permeation chromatography) in compliance with JIS-K-7252-1 (2008). The glass transition temperature (Tg) referred to herein means a temperature determined by DSC (differential scanning calorimetry) in compliance with JIS-K-7121 (2012).

In the exfoliate layer 2 as one example, as long as the release force of the transfer layer 10 and the critical shearing stress of the layer located on the transfer interface of the transfer layer 10 satisfy the above (Condition 1) and (Condition 2), the above acrylic resin having a weight average molecular weight (Mw) of 70000 or more and a glass transition temperature (Tg) of 70° C. or more and 100° C. or less may be combined with another resin material. As the another resin material, acrylic resins, epoxy type resins, polyester type resins, styrene type resins, and the like may be enumerated.

As another example, a device in which the exfoliate layer 2 is allowed to contain a cellulose type resin may be enumerated. In the case where the exfoliate layer 2 contains a cellulose type resin, it is possible to easily adjust the release force of the transfer layer 10 and the critical shearing stress of the layer located on the transfer interface of the transfer layer 10 so as to satisfy the above (Condition 1) and (Condition 2) by adjusting the thickness of the exfoliate layer 2. As the cellulose type resin, cellulose acetate propionate (CAP) resins, cellulose acetate butyrate (CAB) resins, nitro cellulose resins, and the like may be enumerated. It is also possible to adjust the release force of the transfer layer 10 and the critical shearing stress of the layer located on the transfer interface of the transfer layer 10 so as to satisfy the above (Condition 1) and (Condition 2) by using a cellulose type resin other than these resins.

Besides this, it is also possible to adjust the release force of the transfer layer 10 and the critical shearing stress of the layer located on the transfer interface of the transfer layer 10 so as to satisfy the above (Condition 1) and (Condition 2) by allowing the exfoliate layer 2 to contain a release agent together with a resin material and appropriately determining the resin material, type of the release agent, contents of these, and the like. As the release agent, waxes such as polyethylene wax and silicone wax, silicone resins, modified silicone resins, fluorine resins, modified fluorine resins, polyvinyl alcohol resins, acrylic resins, thermosetting epoxy-amino copolymers, thermosetting alkyd-amino copolymers (thermosetting aminoalkyd resins), and the like may be enumerated.

(Second Device)

A second device is a device for adjusting the release force of the transfer layer 10 and the critical shearing stress of the layer located on the transfer interface of the transfer layer 10 so as to satisfy the above (Condition 1) and (Condition 2) by adjusting the thickness of the layer located on the transfer interface of the transfer layer 10, the thickness of the substrate 1, or the thickness of an optional layer to be provided on the other surface of the substrate 1. According to the second device, it is possible to suppress the transfer efficiency of the thermal energy in which the thermal energy applied from the side of the other surface of the substrate 1 is transferred to the transfer layer 10 by appropriately adjusting the thickness of substrate 1 or of an optional layer to be provided on the other surface of the substrate 1 to thereby adjust the release force of the transfer layer 10 so as to satisfy the above (Condition 1). By appropriately adjusting the thickness of the layer located on the transfer interface of the transfer layer 10, it is also possible to impart durability to the layer located on the transfer interface to thereby adjust the critical shearing stress of the layer located on the transfer interface of the transfer layer 10 so as to satisfy the above (Condition 2). It is also possible to suppress the thermal energy transfer efficiency that the thermal energy applied from the other surface of the substrate 1 is transferred to the transfer layer 10 by using materials having a lower thermal energy transfer efficiency as the materials for the substrate 1 and the optional layer provided on the other surface of the substrate 1 instead of the method including adjusting the thickness of the substrate 1 and the optional layer provided on the other surface of the substrate 1.

(Third Device)

A third device is a device for adjusting the release force of the transfer layer 10 and the critical shearing stress of the layer located on the transfer interface of the transfer layer 10 so as to satisfy the above (Condition 1) and (Condition 2) by providing an optional layer to improve the transferability of the transfer layer 10 between the substrate 1 and the transfer layer 10 and appropriately adjusting the thickness of the layer located on the transfer interface of the transfer layer 10. As the optional layer, a release layer and the like may be enumerated. It is also possible to adjust the release force of the transfer layer 10 so as to satisfy the above (Condition 1) by a countermeasure to increase the thickness of the release layer and the like, in addition to the material of the release layer.

As the binder resin contained in the release layer, waxes, silicone wax, silicone resins, modified silicone resins, fluorine resins, modified fluorine resins, polyvinyl alcohol resins, acrylic resins, thermosetting epoxy-amino copolymers, thermosetting alkyd-amino copolymers, and the like may be enumerated. The release layer may be made from one resin or may be made from two or more resins. The thickness of the release layer is generally in the range of 0.2 μm or more and 5 μm or less.

(Fourth Device)

A fourth device is a device for adjusting the release force of the transfer layer 10 and the critical shearing stress of the layer located on the transfer interface of the transfer layer 10 so as to satisfy the above (Condition 1) and (Condition 2) in consideration with the heat resistance of the layer located on the transfer interface of the transfer layer 10. As the device for enhancing the heat resistance of the transfer layer, a method including allowing a cured resin cured by a curing agent to be contained therein and the like may be enumerated.

Instead of or in addition to enhancing the heat resistance of the transfer layer 10 itself, the heat resistance of the optional layer to be provided on the other surface of the substrate 1 may be enhanced.

It is also possible to adjust the release force of the transfer layer 10 and the critical shearing stress of the layer located on the transfer interface of the transfer layer 10 so as to satisfy the above (Condition 1) and (Condition 2) by an appropriate combination of the above first to fourth devices. Alternatively, it is possible to make an adjustment so as to satisfy the above (Condition 1) and (Condition 2) by combination with a method other than these methods.

Hereinafter, the structure of the thermal transfer sheet 100 of one embodiment will be described with reference to one example. The thermal transfer sheet 100 of one embodiment, which is characterized by being adjusted by the devices described above or the like so as to satisfy the above (Condition 1) and (Condition 2), is not limited by the following description with respect to any other conditions.

(Substrate)

The substrate 1, which is an essential constituent in the thermal transfer sheet 100 of one embodiment, retains the transfer layer 10 provided on one surface of the substrate 1 or an optional layer provided between the substrate 1 and the transfer layer 10 (e.g., a release layer (not shown)). There is no particular limitation with respect to the material of the substrate 1, but it is preferred for the material to have heat resistance sufficient to endure the thermal energy when the transfer layer 10 is transferred onto a transfer receiving article (e.g., the heat of a thermal head) and to have mechanical strength sufficient to support the transfer layer 10 and solvent resistance. As the material of the substrate 1, polyester type resins such as polyethylene terephthalate, polybutylene terephthalate, polyethylene naphthalate, polyethylene terephthalate-isophthalate copolymers, terephthalic acid-cyclohexanedimethanol-ethylene glycol copolymers, and polyethylene terephthalate/polyethylene naphthalate coextruded films, polyamide type resins such as nylon 6 and nylon 66, polyolefin type resins such as polyethylene, polypropylene, and polymethylpentene, vinyl type resins such as polyvinyl chloride, acrylic resins such as polyacrylate, polymethacrylate, and polymethyl methacrylate, imide type resins such as polyimide and polyether imide, engineering resins such as polyarylate, polysulfone, polyether sulfone, polyphenylene ether, polyphenylene sulfide (PPS), polyaramid, polyether ketone, polyether nitrile, polyether ether ketone, and polyether sulfite, polycarbonate, styrene type resins such as polystyrene, high impact polystyrene, acrylonitrile-styrene copolymers (AS resins), and acrylonitrile-butadiene-styrene copolymers (ABS resins), and cellulose type resins such as cellophane, cellulose acetate, nitrocellulose, and the like may be enumerated.

There is no particular limitation with respect to the thickness of the substrate 1, and the thickness is generally in the range of 2.5 μm or more and 100 μm or less. It is also possible to suppress the transfer efficiency of thermal energy to be transferred to the transfer layer 10 by increasing the thickness of the substrate 1 more than a thickness in the common range described above to thereby adjust the release force of the transfer layer so as to satisfy the above (Condition 1).

Alternatively, in order to adjust the adhesion between the substrate 1 and the transfer layer 10, it is also possible to subject the surface of the substrate 1 to various surface treatments, for example, corona discharge treatment, flame treatment, ozone treatment, ultraviolet treatment, radiation treatment, roughening treatment, chemical treatment, plasma treatment, low temperature plasma treatment, primer treatment, and grafting treatment.

(Transfer Layer)

As shown in FIGS. 1 to 3, on one surface of the substrate 1, there is provided a transfer layer 10 releasable from the substrate 1. The transfer layer 10 is an essential constituent in the thermal transfer sheet 100 of one embodiment.

The transfer layer 10 referred to herein means a layer to be released from the substrate 1 and transferred onto a transfer receiving article during thermal transfer. The transfer layer 10, if (Condition 1) and (Condition 2) are satisfied in the end, is not limited in any way with respect to its layer structure and components contained in the transfer layer. The transfer layer 10 may have a layered-structure in which two or more layers are layered, as shown in FIGS. 1 and 2, or the transfer layer 10 may have a single-layer structure, as shown in FIG. 3. A release layer (not shown) may also be provided between the substrate 1 and the transfer layer 10. Hereinafter, the transfer layer 10 will be described with reference to one example.

(Transfer Layer of First Aspect)

A transfer layer 10 of a first aspect, as shown in FIG. 1, has a layered-structure in which an exfoliate layer 2 and an adhesive layer 3 are layered in this order from the side of a substrate 1. Instead of the aspect shown in FIG. 1, it is also possible to provide a transfer layer 10 of a single-layer structure constituted singly by an exfoliate layer 2 with no adhesive layer 3 provided on the exfoliate layer 2 and to impart adhesion to this exfoliate layer 2 itself. The thermal transfer sheet 100 including the transfer layer 10 of the first embodiment serves the function of the protective layer transfer sheet of which transfer layer 10 is transferred onto a transfer receiving article to protect the surface of the transfer receiving article. As the adhesive layer 3, it is possible to select and use ones conventionally known as materials for adhesive layers in the field of intermediate transfer media, protective layer transfer sheets and the like. There is no particular limitation with respect to the material of the exfoliate layer 2, and conventionally known materials can be appropriately selected and used, for example, in the case where an adjustment is made by a device other than the above first device so as to satisfy the above (Condition 1) and (Condition 2). The exfoliate layer 2 can be also referred to as a protective layer.

(Transfer Layer of Second Aspect)

A transfer layer 10 of a second aspect, as shown in FIG. 2, has a layered-structure in which an exfoliate layer 2 and a receiving layer 5 are layered in this order from the side of the substrate 1. The thermal transfer sheet 100 having the transfer layer 10 of the second embodiment serves the function of an intermediate transfer medium for obtaining a print by forming a thermally transferable image on the receiving layer of the thermal transfer sheet and transferring the transfer layer including the receiving layer on which the thermally transferable image is formed onto a transfer receiving article. As the receiving layer 5, it is possible to select and use ones conventionally known in the field of thermal transfer image-receiving sheets and intermediate transfer media.

(Transfer Layer of Third Aspect)

A transfer layer 10 of the third aspect has a single-layer structure constituted by a thermally fusible ink layer 7, as shown in FIG. 3. The thermal transfer sheet 100 including the transfer layer 10 of the third aspect serves a function of transferring a thermally fusible ink layer 7 entirely on a transfer receiving article to form a thermally transferable image on the transfer receiving article.

In the transfer layer 10 of the third aspect, the adjustment may be made so as to satisfy the above (Condition 1) and (Condition 2) in consideration of components such as a resin material contained in the thermally fusible ink layer 7 constituting the transfer layer 10, a release agent and the like and the contents of the resin material, the release agent and the like. Alternatively, the adjustment may be made so as to satisfy the above (Condition 1) and (Condition 2) by appropriately selecting the above first to fourth devices.

Alternatively, different transfer layers 10 may be provided on the same surface of the substrate 1, so as to be layered in parallel on the substrate across the surface of the substrate, as being frame sequentially. For example, there may be provided a thermal transfer sheet 100 in which a thermally fusible ink layer 7 as a transfer layer 10 and a layered-structure of an exfoliate layer 2 and an adhesive layer 3 as a transfer layer 10 are provided on the same surface of the substrate 1, so as to be layered in parallel on the substrate across the surface of the substrate, as being frame sequentially.

(Optional Layers)

The thermal transfer sheet 100 of one embodiment may include optional layers not constituting the transfer layer. As optional layers, a release layer described above (not shown), a back face layer provided on the other surface of the substrate 1 in order to improve the heat resistance and the layer structure of heating members such as a thermal head, and the like may be enumerated. For example, in the thermal transfer sheet including the transfer layer 10 of the third aspect described above, a release layer can be provided between the substrate 1 and a thermally fusible ink layer 7 as the transfer layer 10.

(Transfer Receiving Article)

There is no particular limitation with respect to a transfer receiving article onto which the transfer layer 10 of the thermal transfer sheet 100 of one embodiment is transferred, and plain paper, wood-free paper, tracing paper, plastic films, plastic cards mainly composed of vinyl chloride, vinyl chloride-vinyl acetate copolymers, and polycarbonate, thermal transfer image-receiving sheets, and prints each obtained by transferring the transfer layer of an intermediate transfer medium on an optional object may be enumerated.

EXAMPLES

Next, the present invention will be described more concretely with demonstrating examples and comparative examples. Hereinafter, unless otherwise specified, the expression of "part(s)" or % is based on the mass. Mw means a weight average molecular weight, Tg means a glass transition temperature.

(Preparation of Thermal Transfer Sheet 1)

Using a polyethylene terephthalate film of 4.5 μm in thickness (Toray Industries, Inc.) as a substrate, a coating liquid for exfoliate layer 1 having the following composition was coated onto one surface of the substrate so as to obtain a thickness of 0.6 μm after dried, and then the coated liquid was dried, thereby, an exfoliate layer was formed. Then, a coating liquid for adhesive layer having the following composition was coated onto the exfoliate layer so as to obtain a thickness of 0.8 μm in dried state, and then the coated liquid was dried, thereby, an adhesive layer was formed. Additionally, a coating liquid for back face layer having the following composition was coated onto the other surface of the substrate so as to obtain a thickness of 1 μm after dried, and then the coated liquid was dried, thereby a back face layer was formed. Thus, a thermal transfer sheet 1 was obtained, wherein the exfoliate layer and the adhesive layer were provided in this order on one surface of the substrate and the back face layer was provided on the other side of the substrate. In each of Examples and Comparative Examples, a layered-structure of an exfoliate layer and an adhesive layer constitutes the transfer layer.

| <Coating liquid for exfoliate layer 1> | |
|---|---|
| Acrylic resin (Mw: 82000, Tg: 84° C.) (DIANAL(R) MB-2952, Mitsubishi Chemical Corporation) | 15 parts |
| Methyl ethyl ketone | 68 parts |
| Propyl acetate | 17 parts |

| <Coating liquid for adhesive layer> | |
|---|---|
| Polyester resin (Vylon(R) 200, TOYOBO CO., LTD.) | 20 parts |
| Ultraviolet absorbing agent (UVA-635L, BASF Japan) | 10 parts |
| Methyl ethyl ketone | 80 parts |

| <Coating liquid for back face layer> | |
|---|---|
| Polyvinyl butyral resin (S-LEC(R) BX-1, SEKISUI CHEMICAL CO., LTD.) | 10 parts |
| Polyisocyanate curing agent (TAKENATE(R) D218, Mitsui Chemicals, Inc.) | 2 parts |
| Phosphoric ester (PLYSURF(R) A208S, DKS Co. Ltd.) | 2 parts |
| Methyl ethyl ketone | 43 parts |
| Toluene | 43 parts |

(Preparation of Thermal Transfer Sheet 2)

The same procedure as described in Preparation of thermal transfer sheet 1 was repeated, except for coating the coating liquid for exfoliate layer 1 so as to obtain a thickness of 0.4 μm after dried and drying the coated liquid in order to form the exfoliate layer to thereby obtain a thermal transfer sheet 2.

(Preparation of Thermal Transfer Sheet 3)

The same procedure as described in Preparation of thermal transfer sheet 1 was repeated, except for coating the coating liquid for exfoliate layer 1 so as to obtain a thickness of 0.2 μm after dried and drying the coated liquid in order to form the exfoliate layer to thereby obtain a thermal transfer sheet 3.

(Preparation of Thermal Transfer Sheet 4)

The same procedure as described in Preparation of thermal transfer sheet 1 was repeated, except for coating a coating liquid for exfoliate layer 2 having the following composition, instead of the coating liquid for exfoliate layer 1, so as to obtain a thickness of 0.6 μm after dried and drying the coated liquid in order to form the exfoliate layer to thereby obtain a thermal transfer sheet 4.

| <Coating liquid for exfoliate layer 2> | |
|---|---|
| Acrylic resin (Mw: 92000, Tg: 84° C.) (DIANAL(R) MB-7033, Mitsubishi Chemical Corporation) | 15 parts |
| Methyl ethyl ketone | 68 parts |
| Propyl acetate | 17 parts |

(Preparation of Thermal Transfer Sheet 5)

The same procedure as described in Preparation of thermal transfer sheet 4 was repeated, except for coating the coating liquid for exfoliate layer 2 so as to obtain a thickness of 0.4 μm after dried and drying the coated liquid in order to form the exfoliate layer to thereby obtain a thermal transfer sheet 5.

(Preparation of Thermal Transfer Sheet 6)

The same procedure as described in Preparation of thermal transfer sheet 4 was repeated, except for coating the coating liquid for exfoliate layer 2 so as to obtain a thickness of 0.2 μm after dried and drying the coated liquid in order to form the exfoliate layer to thereby obtain a thermal transfer sheet 6.

(Preparation of Thermal Transfer Sheet 7)

The same procedure as described in Preparation of thermal transfer sheet 1 was repeated, except for coating a coating liquid for exfoliate layer 3 having the following composition, instead of the coating liquid for exfoliate layer 1, so as to obtain a thickness of 0.6 μm after dried and drying the coated liquid in order to form the exfoliate layer to thereby obtain a thermal transfer sheet 7.

| <Coating liquid for exfoliate layer 3> | |
|---|---|
| Acrylic resin (Mw: 70000, Tg: 76° C.) (DIANAL(R) MB-3015, Mitsubishi Chemical Corporation) | 15 parts |
| Methyl ethyl ketone | 68 parts |
| Propyl acetate | 17 parts |

(Preparation of Thermal Transfer Sheet 8)

The same procedure as described in Preparation of thermal transfer sheet 7 was repeated, except for coating the coating liquid for exfoliate layer 3 so as to obtain a thickness of 0.4 μm after dried and drying the coated liquid in order to form the exfoliate layer to thereby obtain a thermal transfer sheet 8.

(Preparation of Thermal Transfer Sheet 9)

The same procedure as described in Preparation of thermal transfer sheet 7 was repeated, except for coating the coating liquid for exfoliate layer 3 so as to obtain a thickness of 0.2 μm after dried and drying the coated liquid in order to form the exfoliate layer to thereby obtain a thermal transfer sheet 9.

(Preparation of Thermal Transfer Sheet 10)

The same procedure as described in Preparation of thermal transfer sheet 1 was repeated, except for coating a coating liquid for exfoliate layer 4 having the following composition, instead of the coating liquid for exfoliate layer 1, so as to obtain a thickness of 0.6 μm after dried and drying the coated liquid in order to form the exfoliate layer to thereby obtain a thermal transfer sheet 10.

| <Coating liquid for exfoliate layer 4> | |
|---|---|
| Polyvinyl butyral resin (Tg: 67° C.) (S-LEC(R) BM-1, SEKISUI CHEMICAL CO., LTD.) | 10 parts |
| Methyl ethyl ketone | 45 parts |
| Toluene | 45 parts |

(Preparation of Thermal Transfer Sheet 11)

The same procedure as described in Preparation of thermal transfer sheet 1 was repeated, except for coating a coating liquid for exfoliate layer 5 having the following composition, instead of the coating liquid for exfoliate layer 1, so as to obtain a thickness of 1 μm after dried and drying the coated liquid in order to form the exfoliate layer to thereby obtain a thermal transfer sheet 11.

| <Coating liquid for exfoliate layer 5> | |
|---|---|
| Cellulose acetate butyrate resin (Tg: 101° C.) (CAB-551-0.2, Eastman Chemical Japan Ltd.) | 15 parts |
| Methyl ethyl ketone | 85 parts |

(Preparation of Thermal Transfer Sheet 12)

The same procedure as described in Preparation of thermal transfer sheet 1 was repeated, except for coating a coating liquid for exfoliate layer 1 having the composition described above, instead of the coating liquid for exfoliate layer 1, so as to obtain a thickness of 1 μm after dried and drying the coated liquid in order to form the exfoliate layer to thereby obtain a thermal transfer sheet 12.

(Preparation of Thermal Transfer Sheet 13)

The same procedure as described in Preparation of thermal transfer sheet 1 was repeated, except for coating a coating liquid for exfoliate layer 2 having the composition described above, instead of the coating liquid for exfoliate layer 1, so as to obtain a thickness of 1 μm after dried and drying the coated liquid in order to form the exfoliate layer to thereby obtain a thermal transfer sheet 13.

(Preparation of Thermal Transfer Sheet 14)

The same procedure as described in Preparation of thermal transfer sheet 1 was repeated, except for coating a coating liquid for exfoliate layer 3 having the composition described above, instead of the coating liquid for exfoliate layer 1, so as to obtain a thickness of 1.2 μm after dried and drying the coated liquid in order to form the exfoliate layer to thereby obtain a thermal transfer sheet 14.

(Preparation of Thermal Transfer Sheet A)

The same procedure as described in Preparation of thermal transfer sheet 1 was repeated, except for coating a coating liquid for exfoliate layer A having the following composition, instead of the coating liquid for exfoliate layer 1, so as to obtain a thickness of 0.6 μm after dried and drying the coated liquid in order to form the exfoliate layer to thereby obtain a thermal transfer sheet A.

| <Coating liquid for exfoliate layer A> | |
|---|---|
| Acrylic resin (Mw: 25000, Tg: 105° C.) (DIANAL(R) BR-87, Mitsubishi Chemical Corporation) | 15 parts |
| Methyl ethyl ketone | 68 parts |
| Propyl acetate | 17 parts |

(Preparation of Thermal Transfer Sheet B)

The same procedure as described in Preparation of thermal transfer sheet 1 was repeated, except for coating a coating liquid for exfoliate layer B having the following composition, instead of the coating liquid for exfoliate layer 1, so as to obtain a thickness of 0.6 μm after dried and drying the coated liquid in order to form the exfoliate layer to thereby obtain a thermal transfer sheet B.

| <Coating liquid for exfoliate layer B> | |
|---|---|
| Acrylic resin (Mw: 16000, Tg: 50° C.) (DIANAL(R) BR-101, Mitsubishi Chemical Corporation) | 15 parts |
| Methyl ethyl ketone | 68 parts |
| Propyl acetate | 17 parts |

(Preparation of Thermal Transfer Sheet C)

The same procedure as described in Preparation of thermal transfer sheet 1 was repeated, except for coating a coating liquid for exfoliate layer C having the following composition, instead of the coating liquid for exfoliate layer 1, so as to obtain a thickness of 0.6 μm after dried and drying the coated liquid in order to form the exfoliate layer to thereby obtain a thermal transfer sheet C.

| <Coating liquid for exfoliate layer C> | |
|---|---|
| Acrylic resin (Mw: 7000, Tg: 57° C.) (1FM-1072, TAISEI FINE CHEMICAL CO., LTD.) | 15 parts |
| Methyl ethyl ketone | 85 parts |

(Preparation of Thermal Transfer Sheet D)

The same procedure as described in Preparation of thermal transfer sheet 1 was repeated, except for coating a coating liquid for exfoliate layer D having the following composition, instead of the coating liquid for exfoliate layer 1, so as to obtain a thickness of 0.6 μm after dried and drying the coated liquid in order to form the exfoliate layer to thereby obtain a thermal transfer sheet D.

| <Coating liquid for exfoliate layer D> | |
|---|---|
| Vinyl chloride - vinyl acetate copolymer (Mw: 35,000, Tg: 76° C.) (SOLBIN(R) CNL, Nissin Chemical Co., Ltd.) | 15 parts |
| Methyl ethyl ketone | 68 parts |
| Propyl acetate | 17 parts |

(Preparation of Thermal Transfer Sheet E)

The same procedure as described in Preparation of thermal transfer sheet 1 was repeated, except for coating a coating liquid for exfoliate layer 5 having the composition described above, instead of the coating liquid for exfoliate layer 1, so as to obtain a thickness of 0.6 μm after dried and drying the coated liquid in order to form the exfoliate layer to thereby obtain a thermal transfer sheet E. The thermal transfer sheet E is different from the thermal transfer sheet 11 only in the thickness of the exfoliate layer.

(Calculation of Tensile Strength (Calculation of Release Force))

Each of the thermal transfer sheets formed above and a transfer receiving article were combined. Then, while the transfer layer of the thermal transfer sheet was transferred onto the transfer receiving article using the following hot release-type test printer 1, the transfer layer transferred was released from the substrate at a release angle of 50° to obtain a print in which the transfer layer was provided on the transfer receiving article. As the transfer receiving article, a genuine image receiving sheet for a sublimable type thermal transfer printer (DS-40, Dai Nippon Printing Co., Ltd.) was used.

When this print was obtained, the stress of the thermal transfer sheet, at the timing when the transfer layer transferred onto the transfer receiving article was released from the substrate at a release angle of 50°, was measured by a tension meter (model ASK-1000, OHKURA INDUSTRY) provided between the thermal transfer sheet winding roller and the heating device (thermal head) in the printer. Subsequently, the stress determined by the tension meter was divided by the heating width of the thermal transfer sheet (width of energy application) to calculate the tensile strength value. The measurement results of the tensile strength are shown in Table 1.

(Test Printer 1 (Hot Release-Type))

Heater average resistance: 5241 (Ω)
Main scanning direction printing density: 300 (dpi)
Sub scanning direction printing density: 300 (dpi)
Printing voltage: 28 (V)
Applied power for printing: 0.15 (W/dot)
Applied energy: 0.127 (mJ/dot)
Line cycle: 1 (msec./line)
Pulse duty: 85(%)
Printing start temperature: 29.0 (° C.) to 36.0 (° C.)
Distance from heating point to release plate: 4.5 (mm)
Conveying speed: 84.6 (mm/sec.)
Printing pressure: 3.5 to 4.0 (kgf) (34.3 to 39.2(N))
Evaluation image (energy gradation): 255/255-gradation image (Measurement of Critical Shearing Stress)

The surface of the print (the surface of the exfoliate layer) obtained in the measurement of the tensile strength described above was measured by a micro-scratch method in compliance with JIS-R-3255 (1997). The critical shearing stress of the print surface (exfoliate layer surface) is also shown in Table 1.

In Table 1, the thermal transfer sheets in which the release force of the transfer layer (the tensile strength of the thermal transfer sheet) and the critical shearing stress of the layer located on the transfer interface of the transfer layer satisfy the above (Condition 1) and (Condition 2) are the thermal transfer sheet of Examples, and the thermal transfer sheets in which either one of the above (Condition 1) or the above (Condition 2) is not satisfied are the thermal transfer sheets of Comparative Examples.

(Thermal Fusion Evaluation)

The combinations of a thermal transfer sheet and a transfer receiving article of each of Examples and Comparative Examples shown in Table 1 were evaluated for the thermal fusion when the transfer layer was transferred onto the thermal transfer image-receiving sheet using the hot release-type test printer 1 described above in accordance with the following evaluation criteria. The evaluation results are also shown in Table 1.

"Evaluation Criteria"

A: No thermal fusion occurs, and the transfer layer can be well released from the substrate.

NG: Thermal fusion occurs partially or entirely in the transfer layer, and it is not possible to release the transfer layer partially or entirely from the substrate.

(Evaluation of Foil Fall)

Each of the thermal transfer sheets constituting the combination of each of Examples and Comparative Examples shown in Table 1 was cut and pasted on the protective layer panel of a genuine ribbon for a sublimable type thermal transfer printer (DS-40, Dai Nippon Printing Co., Ltd.) and left to stand under an environment of a temperature of 22.5° C. and a humidity of 50% for an hour. Then, using the above sublimable type thermal transfer printer, the transfer layer of the thermal transfer sheet used for the combination of each of Examples and Comparative Examples was transferred onto a genuine image receiving sheet for the sublimable type thermal transfer printer under a 128/255 energy gradation condition to thereby obtain a print. The state of the surface of each of the prints transferred was visually observed, and the foil fall of the transfer layer was evaluated in accordance with the following evaluation criteria. The evaluation test results are also shown in Table 1. Occurrence of foil fall means that a portion or the whole of the transfer layer has fallen off inside the printer.

"Evaluation Criteria"

A: No foil fall of the transfer layer occurred, and the print has no defect.

NG: Defects due to foil fall of the transfer layer can be observed in the print.

(Evaluation of Foil Cutting Property)

The tailing state of an edge of the print, obtained in the evaluation of foil fall on the transfer layer described above, was observed, and the foil cutting property was evaluated in accordance with the following evaluation criteria. The evaluation test results are shown in Table 1. Only the thermal transfer sheets of Examples were subjected to the evaluation of foil cutting property.

"Evaluation Criteria"

A: No tailing occurs.

B: The length of tailing is less than 0.1 mm.

C: The length of tailing is 0.1 mm or more.

TABLE 1

| | Type of thermal transfer sheet | Release force tensile strength) ($\times 10^{-2}$ N/cm) | Critical shearing stress ($\times 10^{8}$ N/m$^{2}$) | Thermal fusion evaluation | Foil fall evaluation | Foil cutting property evaluation |
|---|---|---|---|---|---|---|
| Example 1 | Thermal transfer sheet 1 | 1.8 | 1.544 | A | A | A |
| Example 2 | Thermal transfer sheet 2 | 2.1 | 1.361 | A | A | A |
| Example 3 | Thermal transfer sheet 3 | 2.5 | 1.177 | A | A | A |
| Example 4 | Thermal transfer sheet 4 | 0.8 | 1.631 | A | A | A |
| Example 5 | Thermal transfer sheet 5 | 0.9 | 1.427 | A | A | A |
| Example 6 | Thermal transfer sheet 6 | 1.1 | 1.223 | A | A | A |
| Example 7 | Thermal transfer sheet 7 | 6.5 | 1.289 | A | A | A |
| Example 8 | Thermal transfer sheet 8 | 6.7 | 1.223 | A | A | A |
| Example 9 | Thermal transfer sheet 9 | 7.2 | 1.157 | A | A | A |
| Example 10 | Thermal transfer sheet 10 | 3.0 | 2.089 | A | A | C |
| Example 11 | Thermal transfer sheet 11 | 3.4 | 1.170 | A | A | A |
| Example 12 | Thermal transfer sheet 12 | 1.6 | 1.920 | A | A | B |
| Example 13 | Thermal transfer sheet 13 | 0.8 | 2.060 | A | A | C |
| Example 14 | Thermal transfer sheet 14 | 6.0 | 1.810 | A | A | B |
| Comparative Example 1 | Thermal transfer sheet A | 17.7 | 1.289 | NG | A | — |
| Comparative Example 2 | Thermal transfer sheet B | 0.6 | 0.678 | A | NG | — |
| Comparative Example 3 | Thermal transfer sheet C | 0.5 | 0.408 | A | NG | — |
| Comparative Example 4 | Thermal transfer sheet D | 78.4 | 0.953 | NG | A | — |
| Comparative Example 5 | Thermal transfer sheet E | 3.8 | 0.749 | A | NG | — |

REFERENCE SIGNS LIST

1 Substrate
2 Exfoliate layer
3 Adhesive layer
5 Receiving layer
7 Thermally fusible ink layer
10 Transfer layer
100 Thermal transfer sheet
200 Printer
201 Thermal transfer sheet supplying device (supplying roller)
202 Heating device (thermal head)
203 Thermal transfer sheet winding device (winding roller)
204 Measuring device (tension meter)
205 Release device (release plate)
300 Transfer receiving article

The invention claimed is:

1. A thermal transfer sheet comprising:

a substrate; and a transfer layer provided on one surface of the substrate, wherein the transfer layer has a single-layer structure constituted by an exfoliate layer, or a layered-structure including an exfoliate layer located nearest the substrate, and wherein the exfoliate layer contains an acrylic resin having a weight average molecular weight (Mw) in a range of 70000 or more to 92000 or less, and a glass transition temperature (Tg) in a range of 70° C. or more to 100° C. or less.

2. The thermal transfer sheet according to claim 1, wherein a thickness of the exfoliate layer is in a range of 0.2 μm or more to 0.6 μm or less.

3. A thermal transfer sheet according to claim 1, wherein the transfer layer has a release force of $7.5\times10^{-2}$ N/cm or less, and wherein the release force of the transfer layer is a tensile strength of the thermal transfer sheet measured by a measuring device at a time when, while the transfer layer is transferred onto a transfer receiving article by use of a printer comprising a thermal transfer sheet supplying device, a heating device, a thermal transfer sheet winding device, the measuring device located between the heating device and the thermal transfer sheet winding device to measure the tensile strength of the thermal transfer sheet conveyed along a conveyance path, and a release device located between the heating device and measuring device, under conditions including an applied energy of 0.127 mJ/dot and a conveying speed for the thermal transfer sheet of 84.6 mm/sec., the transfer layer transferred on the transfer receiving article is released from the thermal transfer sheet at a release angle of 50°.

4. The thermal transfer sheet according to claim 3, wherein the transfer layer has a release force in a range of $0.8\times10^{-2}$ N/cm or more to $7.5\times10^{-2}$ N/cm or less.

* * * * *